United States Patent [19]

Kajitsuka

[11] Patent Number: 4,488,408

[45] Date of Patent: Dec. 18, 1984

[54] COOLING METHOD AND SYSTEM THEREFOR

[75] Inventor: Senri Kajitsuka, Kodaira, Japan

[73] Assignee: Taikisha Ltd., Tokyo, Japan

[21] Appl. No.: 436,901

[22] Filed: Oct. 27, 1982

[30] Foreign Application Priority Data

Oct. 30, 1981 [JP] Japan ..... 56-175292

[51] Int. Cl.[3] ..... F25B 41/00

[52] U.S. Cl. ..... 62/113; 62/235.1; 62/277; 62/476; 62/513

[58] Field of Search ..... 62/314, 305, 235.1, 62/113, 476, 277, 279, 513, 238.3; 165/16, 62; 237/2 B

[56] References Cited

U.S. PATENT DOCUMENTS 4,089,916 5/1978 Hay ..... 62/314

4,300,623 11/1981 Meckler ..... 165/16

*Primary Examiner*—Henry Bennett

*Attorney, Agent, or Firm*—Jordan and Hamburg

[57] ABSTRACT

A cooling method and a system therefor to remove sensible heat of a whole room to be cooled installed with a cooler of an absorption refrigerator utilizing a heating medium, and to dehumidify air of the room by utilizing thermal energy of the heating medium for regenerating the dehumidifying function of the dehumidifier. The cooling system includes an absorption refrigerator utilizing a heating medium heated by solar heat, a cooler having a relatively large panel area exposed to a room, a dehumidifier for dehumidifying indoor air by utilizing the thermal energy of the heating medium heated by solar heat, and an outlet element for blowing dehumidified air coming from the dehumidifier to the cooler.

15 Claims, 3 Drawing Figures

COOLING METHOD AND SYSTEM THEREFOR

BACKGROUND OF THE INVENTION (1) Field of the Invention

The present invention relates to a cooling method and a system therefor utilizing an absorption refrigerator.

(2) Description of the Prior Art

In a known cooling system utilizing solar heat, water is heated by solar heat to 80°-100° C. for use in heating and enriching (namely recovering) an aqueous solution of lithium bromide of an absorption refrigerator and the enriched aqueous solution of lithium bromide is used to absorb and evaporate water in vacuum to produce cold water at about 7° C. for cooling the cooler of an air conditioner. The air conditioning cycle of this known system requires the cooler, which is cooled by the cold water, to carry out both removal of sensible heat from the room to be cooled and dehumidification of the air by forming a collecting dew, and therefore needs cold water of lower temperature (5°-7° C.) than in the case of removing sensible heat only. This has a disadvantage of operating the refrigerator at a low coefficient of performance.

Furthermore, the cooler of the known system is mounted in a blowing system for the room to be cooled rather than installed in the room itself since dew is formed and collected by the cooler. Therefore, in order to remove sensible heat from the room, room air must be passed through the cooler mounted in the blowing system. This process has the disadvantage of requiring extra power for blowing in that such a cooler has a relatively small air passage area and besides offers a great air flow resistance in order to provide a necessary degree of cooling.

On the other hand, it is known that in regions having relatively low humidity dew does not form and drip easily and therefore the cooler may be installed in the room to remove sensible heat therefrom by using cold water at a relatively high temperature while at the same time saving power for circulating air in and out of the room. However, this system is not suitable for a region like Japan where humidity is high during summer. Thus, a cooling method and system has been sought which is amply efficient in regions of high humidity for removing sensible heat generated within a room or entering the room from outside and in carrying out efficient dehumidifying as well.

SUMMARY OF THE INVENTION

The object of this invention is to reduce overall energy consumption in a cooling system utilizing solar heat in which a heating medium such as water heated by solar heat is applied to an absorption refrigerator and to a dehumidifier, sensible heat being removed by a cooler such as a cooling panel on a ceiling by using cold water at a relatively high temperature thereby improving the coefficient of performance of the absorption refrigerator, and dehumidification being carried out by the dehumidifier with a reduced amount of blower circulation.

In order to achieve the above object a cooling method according to the present invention comprises removing sensible heat from a cooling load by an indoor cooler receiving a circulating cooling medium from an adsorption refrigerator utilizing a heating medium and dehumidifying the cooling load by a dehumidifier utilizing the heating medium for regenerating the dehumidifying function thereof.

The above method has the following advantages: (1) The coefficient of performance of the absorption refrigerator is improved (i.e. the energy consumption in relation to the refrigerating power is reduced), and calorie losses in the outdoor equipment are reduced. Consequently the auxiliary heat source for heating water, the solar collector, the heat collecting area and the absorption refrigerator may all be small. (2) The cold water storage tank of this system has a cold storage capacity several times the capacity of an similarly dimensioned cold water storage tank of a conventional cooling system. (3) Since the amount of blower circulation for dehumidification is small, the system consumes a small amount of energy and produces little noise.

Moreover, the invention is easy to practise and has wide application because of the following advantages: (4) The air in the room being cooled is in the cool ceiling and warm floor condition which is healthy, and the temperature and humidity are adjusted with high precision. (5) There occurs no unpleasant cold draft, which is desirable to sanitation particularly where aged people, infants or patients with serious illnesses are present. (6) During the intermediate seasons (i.e. spring and autumn) the system supplies the room entirely with outdoor air after dehumidifying it without returning the air taken from the room, which is useful for the prevention of airborne infection within a hospital, for sterile rooms where avoidance of bacterial contamination is necessary, and for the prevention of accidents in factories where poisonous gas is used.

Furthermore, the cooling system according to the present invention comprises an absorption refrigerator utilizing a heating medium heated by solar heat, a cooler having a relatively large panel area exposed to a room, a dehumidifier for dehumidifying indoor air by utilizing the thermal energy of the heating medium heated by solar heat, and outlet means for blowing dehumidified air coming from the dehumidifier to the cooler.

The indoor installation of the cooler having a large cooling panel area according to the above system produces the following effect in addition to the cooling effect produced by convection of cooled air as in the prior art system: Even at an indoor air temperature 2° or 3° C. higher than the temperature provided by the prior art system, a reduced effect of mean radiation temperature, which is colder than the human body, the large area cooling panel produces a cooling effect on people present in the room which is comparable with or even more comfortable than the effect produced by the prior art system.

Dehumidification is carried out by the dehumidifier whose dehumidifying function is regenerated by utilizing solar heat; and, energy for the dehumidification is consumed with an improved efficiency, whereby dew condensate is not formed on the cooler, thus allowing the cooler to be installed in the room. Compared with the prior art in which the cooler is installed outside the room and dew is caused to form therein in a positive manner, the system of this invention has a high cooling efficiency without requiring very low water temperatures.

Other advantages of the present invention will be apparent from the following description.

DESCRIPTION OF THE PREFERRED EMBODIMENT

Figure 1:
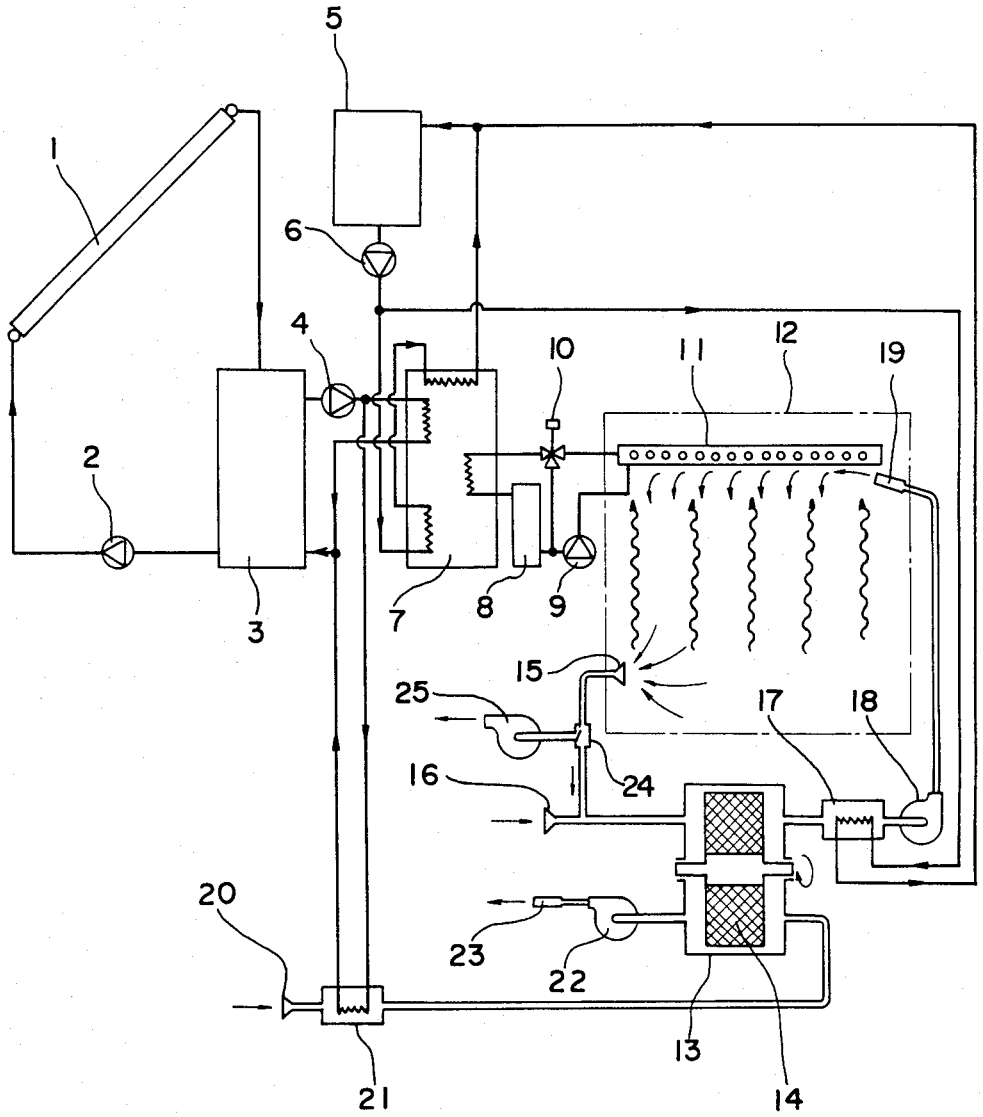
FIG. 1 is a schematic diagram of a cooling system according to this invention.

FIG. 1 is a schematic flowsheet of a solar heat utilizing the cooling system embodying the present invention.

Figure 2:
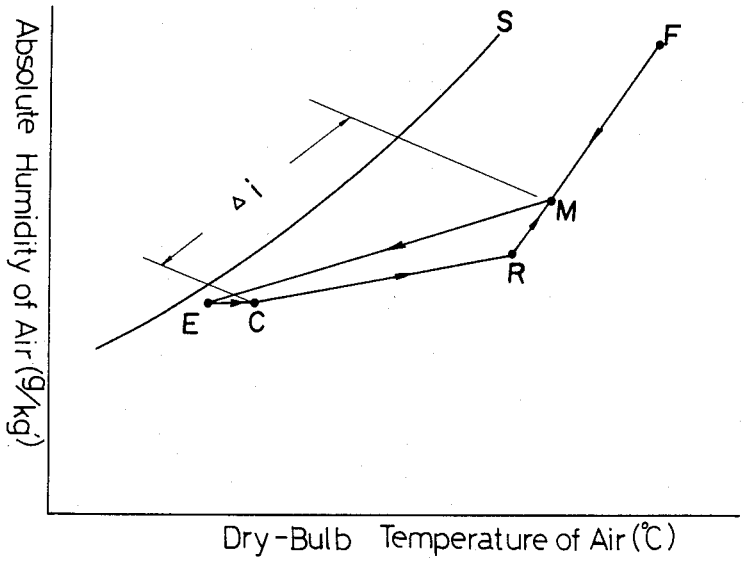
FIG. 2 is a graph illustrating the air cycle of a prior art method.

FIG. 2 shows, on a moist air psychrometric diagram, a cooling air cycle provided by a prior art absorption refrigerator.

Figure 3:
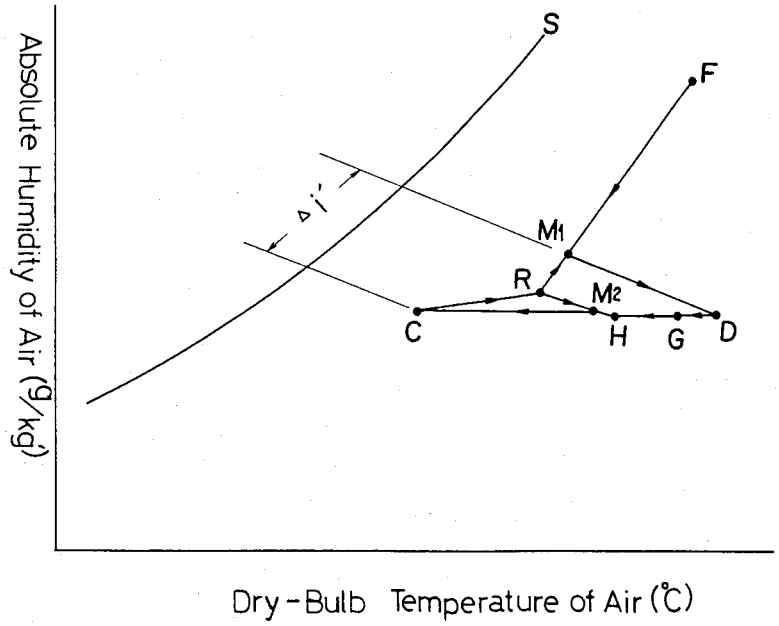
FIG. 3 is a graph illustrating the air cycle of the present invention.

FIG. 3 shows, on a moist air psychrometric diagram, an air cycle in the cooling system embodying the present invention, in which return air is also dehumidified.

The reference characters in FIG. 1 denote the following:

1: a solar collector
2: a lift pump
3: a heat storage tank
4: a hot water circulation pump
5: a cooling tower
6: a cooling water circulation pump
7: an absorption refrigerator (an absorption liquid line and a cooling medium or water line being omitted)
8: a cold water storage tank
9: a cold water circulation pump
10: a three-way valve
11: a cooling panel, which is referred to as a cooler in this invention, installed on the ceiling of a room to be cooled
12: the room to be cooled
13: a dry type dehumidifier
14: a dry type dehumidifying rotor comprising activated carbon fibers
15: a return air inlet of the room to be cooled
16: an outdoor air inlet
17: a sensible heat cooler for dehumidified air
18: a fan for supplying the dehumidified air
19: a dehumidified air outlet in the room to be cooled
20: a recovery air inlet connected to the dehumidifying rotor
21: a heater for regenerating air for the dehumidifying rotor
22: a fan for regenerating air for the dehumidifying rotor
23: an exhaust port for the recovery air for the dehumidifying rotor
24: a switch damper
25: an exhaust fan In FIG. 2, Axis of ordinate: absolute humidity of air
Axis of obscissa: dry bulb temperature of air
F: an outdoor air condition point
R: an indoor air condition point
M: a condition point for a mixture of outdoor air and indoor air (namely return air)
E: a condition point for the air at an outlet of the air cooler
C: a condition point for the air blown into the room being cooled
S: a saturation curve In FIG. 3, F: an outdoor air condition point
R: an indoor air condition point
M1: a condition point for a mixture of outdoor air and indoor air (namely return air)
D: a condition point for air adiabatically heated through dehumidification
G: a condition point for dehumidified air slightly cooled by cooling water
H: a condition point for the dehumidified air further cooled through heat conduction and radiation by the cooling panel on the ceiling
M2: a condition point for a mixture resulting from natural convection between part of the indoor air at the condition point R and the dehumidified air at the condition point H
C: a condition point for the air having been deprived of sensible heat and cooled from the point M2 through negative radiation by the cooling panel on the ceiling
S: a saturation curve Referring to FIG. 1, water in a heat storage tank 3 is extracted from its bottom and is delivered to a lower header of the solar collector 1 by a lift pump 2. The water is heated in the collector 1 by solar heat to about 90° C. during the height of summer and leaves the collector 1 from its upper header to return through a piping to the top of the heat storage tank 3. The above cycle is repeated. The heat storage tank 3 has a storage capacity far exceeding the amount of water circulation and is therefore capable of considerable heat preservation for sunless hours. The water in the tank 3 is hotter toward the top and colder toward the bottom. An auxiliary heat source run by electricity or fuel is required although not shown in the drawing. The high temperature water (hereinafter called the hot water) in the upper portion of the heat storage tank 3 is delivered at about 80° C. by a circulation pump 4 to a heating coil of a refrigerator 7 for enriching or recovering an aqueous solution of lithium bromide and to a heating coil of a heater 21 for heating regenerating air for a dehumidifying rotor 14. The water returns to the bottom portion of the heat storage tank 3 after being cooled in the respective heating coils. Though not shown, a flow control valve is mounted at a branch-off point of water supply piping immediately downstream of the pump 4 to regulate distribution of the water flow.

Water in a cooling tower 5 is drawn from its bottom by a cooling water circulation pump 6 to be partly delivered to an absorption liquid cooling coil and a cooling medium or water condensing coil of the absorption refrigerator 7 and partly delivered to a cooling coil of a dehumidified air sensible heat cooler 17. The water having been heated in the respective coils returns to an upper portion of the cooling tower 5 and is cooled there to be put into further circulation for cooling purposes. A flow distribution control valve (not shown) is also mounted at a branch-off point of water supply piping immediately downstream of a pump 6.

The cooling medium or water which evaporates in vacuum inside the absorption refrigerator 7 cools water from outside the cooling coil. The water cooled to about 15° C. (hereinafter referred to as cold water) is stored in a cold water storage tank 8 from the bottom of which the cold water is extracted by a cold water circulation pump 9 and delivered to a cooling panel 11 on the ceiling of a room 12 to be cooled. The absorption refrigerator 7 generally is capable of producing cold water whose temperature upon leaving the storage tank 8 is 7°

C. However, the cold water sent to the cooling panel 11 need not be at such a low temperature and, to avoid condensation on the cooling panel, part of the water returning from the panel 11 to the cold water storage tank 8 is taken from a return piping by a three-way valve 10 and a bypass pipe and fed to an intake pipe of a pump 9, whereby the cooling panel 11 receives the water at a temperature ranging between about 18° and 22° C. Thus the temperature of the water returning from the cooling panel 11 is about 23°-28° C. Since the temperature of the water leaving the cold water storage tank 8 may be about 18° C., the refrigerator 7 runs at a higher coefficient of performance than when producing cold water of 7° C. When solar heat collection is excessive relative to the cooling load, the water cooling operation may be automatically stopped when the water within the storage tank 8 is at 7° C. from top to bottom, thereby to achieve cold storage.

Various types of ceiling cooling panel 11 are available, such as a combination of a cooling coil and a sheet metal, a combination of a cooling coil and plywood, a cooling coil embedded in a concrete slab of the ceiling, and two flat or uneven sheets of metal welded or otherwise adhered to each other one on top of the other to permit passage of cooling water in between.

The ceiling cooling panel 11 in the cooling system of the present invention may comprise any one of the above types or a different type. The important thing is that the cooling panel 11 functions to absorb heat from indoor air, heat sources, walls and the floor and to allow air cooled by the cooling panel to descend through natural convection. Besides, instead of the panel on the ceiling a flat panel cooler may be provided on a side wall and adjacent the ceiling, or the panel may be mounted on a side wall.

Since the cooling panel cools the air by reduction of the effect of the mean radiation temperature and natural convection, the air feels cooler than its actual temperature (i.e. lower effective temperature) and therefore the indoor air temperature can be set at a higher temperature which contributes to energy saving. For example, an actual room temperature of 28° C. feels to the human body like 26° C. The room temperature will easily be uniform without forcibly circulating the air, and this too helps toward energy saving, and the system is quiet and ideal for healthy cool ceiling and warm floor temperature conditions.

The cooling panel on the ceiling will easily form dew in Japan during summer when the air is very humid. In order to avoid the formation of dew an air dehumidifier is required, and the cooling system according to this invention employs the dehumidifier whose function in regenerated by air heated to about 70° C. by hot water at about 80° C. heated by solar heat and which comprises sterilized activated carbon fibers.

The dehumidifier 13 shown in FIG. 1 has a cylindrical metal housing enclosing a columnar rotor 14 comprising a honeycomb block formed of corrugated layers of paper containing activated carbon fibers therein, which rotor is rotatable slowly at a constant angular speed. The housing has an air inlet space and an air outlet space divided by a radially mounted partition plate into two parts, i.e. a dehumidifying part and a regenerating part. The activated carbon fiber block of the rotor, when in the dehumidifying part of the housing dehumidifies air to be sent to the room being cooled by adsorbing its moisture and, when rotated to the regenerating part of the housing, desorbs the moisture from the recovery air which has been heated to about 70° C. by the hot water heated by solar heat and is flowing counter to the air going to the room being cooled. Such a rotary type dehumidifier that continuously repeats the dehumidifying and regenerating cycle is known, but the known dehumidifier comprises a honeycomb shaped block formed of asbestos fibers soaked with lithium chloride which is undesirable to hygiene. If soaked with other substance such as silica gel for example, then the dehumidifying function is regenerated to a satisfactory degree only by recovery air at a temperature of 100° C. or higher and therefore water heated by solar heat cannot be utilized.

Compared with the known type of rotary dehumidifiers, a dehumidifier using fine activated carbon such as activated carbon fibers is not only hygienic but also advantageous from the point of view of energy saving in that it is regeneratable at a low temperature of 70° C. and therefore warm water (below 100° C.) heated by solar heat or low temperature industrial waste heat will serve the purpose of regenerating the dehumidifier. A dehumidifier using fine activated carbon may not be the rotary type but the fixed bed type. However, the rotary type is preferable since it has a smaller heat loss, requires a smaller installation area and is easier to maintain.

Other adsorbing material than fine activated carbon may be employed for the dehumidifier in the cooling system according to the present invention so long as it is efficiently regenerated by warm water of about 70°-80° C. heated by solar heat.

Where the air dehumidified by the dehumidifier comprises a mixture of air extracted from the room 12 via a return air inlet 15 and outdoor air taken in via an outdoor air inlet 16 (in other words, when the damper 24 is closed to permit no air flow to the exhaust fan 25 and the latter is at rest), the air mixture contains moisture of about 15 g/kg′ absolute humidity (g is moisture mass and kg′ is dry air mass) if outdoor conditions are 34° C. in temperature and 60% in relative humidity and indoor conditions of the room 12 are 28° C. in temperature and 60% in relative humidity during summer. During the height of summer when outdoor air has an absolute humidity as high as 20 g/kg′, it is not feasible to dehumidify only outdoor air for delivery to the room to be cooled. But during the intermediate seasons when the outdoor temperature is only slightly higher than the indoor temperature and the absolute humidity does not exceed 15 g/kg′, outdoor air alone is dehumidified and supplied to the room and the air extracted from the room is vented to the atmosphere, without being dehumidified, by operating the damper and the exhaust fan.

In either case, the mixed air or outdoor air gets dehumidified by about 2.5-3.0 g/kg′ and at the same time adiabatically heated by about 6° C. when passing through the dehumidifying rotor 14. The air is then cooled to about 34° C. at the cooling coil of the sensible heat cooler 17 by the cooling water from the cooling tower 5 and is sent to an air outlet 19 to be blown off in a direction substantially parallel to the undersurface of the cooling panel 11 disposed on the ceiling.

FIG. 3 shows the air cycle for dehumidifying the mixed air.

The undersurface of the ceiling cooling panel 11 is constantly swept, as described above, by the dehumidified air having a dew point of about 17° C., and therefore humid air (at 14 g/kg′ absolute humidity and 19° C. dew point) rising through natural convection from lower parts of the room 12 being cooled does not condense upon direct contact with the cooling panel 11 (whose undersurface temperature is 18°-23° C.). Instead, the rising air mixes with the dehumidified air cooled through heat conduction and radiation and descends through natural convection while losing its sensible heat, by radiation, to the ceiling cooling panel 11 as shown by upwardly directed undulating arrows. The sensible heat of indoor heat sources (such as lighting fixtures, motors and human bodies), walls and the floor advances from their respective surfaces toward the cooling panel 11 on the ceiling although not shown by arrows in the drawing. While it is characteristic of radiation cooling to produce a slight temperature difference between upper and lower parts of the room, naturally the indoor air has higher temperature and humidity toward the floor, hence a return air inlet 15 is located adjacent to the floor. The indoor air extracted via the air inlet 15 is drawn, together with outdoor air taken in at an outdoor air inlet 16, into the dehumidifier 13 to be dehumidified, or released to an atmosphere via the exhaust fan 25, or else discharged into the cooling tower 5 in order to help to lower the temperature of the cooling water therein.

The dehumidifying rotor 14 repeats the cycle while moving at a low angular speed in the dehumidifying part of the housing, adsorbs moisture from the air passing therethrough and, while in the regeneration part of the housing, gets sufficiently dried by having the adsorbed moisture taken off by heated air at about 70° C. flowing counter to the aforesaid air, the rotor 14 thereafter moving into the dehumidifying part to adsorb moisture again.

In the cooling system according to the present invention, dehumidification is carried out by a dehumidifier 13 specially provided for the purpose described above and not by the cooler. Consequently the cooling water may be at a higher temperature than in a conventional cooling system in which dehumidification is carried out through condensation by cooling, and the surface temperature of the cooling panel may be higher owing to the effective temperature as already described. The circulating air blown out of the air outlet 19 is intended only for dehumidification of the indoor air and not for cooling of sensible heat or forcible movement of air. Therefore its flow may be far lower than the amount of blast circulation in the known cooling system.

The cooling coil using cold water at 7° C. as in the conventional cooling system is no longer necessary and the air duct may have a small surface area. Moreover, because the air temperature and the water temperature are high, calorie losses are sufficiently small even if outdoor ducts and pipes are not provided with a thermal insulation or are simplified. Calorie losses at the cold water storage tank 8 are also small and a cold input more than enough may be stored therein. In the conventional cooling system the calorie losses in outdoor cooling coils, ducts and pipes are 5-10% of the input while in the cooling system according to the present ainvention the outdoor calorie losses are drastically reduced and are estimated to be one or two percent at most.

The mass flow rate of the dehumidifying rotor recovery air is about one fourth of the mass flow rate of the air to be dehumidified. While other adsorbing material requires air heated to 100° C. or higher for its regeneration, the material used in this invention can be regenerated by using heated air of 70° C. and so its recovery consumes less energy.

Condensation on the cooling panel on the ceiling may corrode panel parts made of metal though condensate may not drip down. In order to ensure that the undersurface of the cooling panel 11 is swept by the dehumidified air in an effective manner, the dehumidified air should be blown out of the air outlet 19 at a good velocity in a slightly upward direction, that is in a direction at an acute angle to the panel undersurface.

When starting a cooling operation, the hot water circulation line is started first and the dehumidified air line is started next. After a humidity sensor detects that the undersurface of the cooling panel on the ceiling is covered with the dehumidified air, the cooling water circulation line is started whereby the cooling water is circulated to the cooling panel 11 in a controlled manner by the pump 9.

When stopping the operation of the cooling system, the circulation lines are stopped in the reverse order and the cooling water circulation is stopped first and, after the temperature of the cooling panel has risen enough to be free from condensation, the dehumidified air circuation is stopped.

Referring to FIG. 2, in the air cycle according to the conventional cooling system, indoor air at condition point R is mixed with outdoor air at condition point F and comes to condition point M. The air is then cooled by a coil which is in turn cooled by cooling water of about 7° C. and is at the sametime dehumidified through condensation to come to condition point E. The air is heated again to the condition point C by ducts and the like and blown into the room where the air is heated and humidified to condition point R by a thermal load in the room being cooled. The enthalpy carried away by dry air of 1 kg' from the room being cooled is $\Delta i$Kcal. The cooling coil must be cooled by cold water of a sufficiently low temperature since removal of sensible heat and dehumidification are carried out by the cold water as described, which renders energy saving difficult to achieve.

Referring to FIG. 3, in the air cycle according to the cooling system of the present invention (where the extracted air also is dehumidified), indoor air at condition point R is mixed with outdoor air at condition point F and comes to condition point M. The air is first dehumidified by the dehumidifier and is at the same time adiabatically heated to condition point D. The dehumidified air is cooled by the cooling water sent from the cooling tower to about 34° C. and comes to condition point G, which is cooled at the undersurface of the cooling panel through heat conduction and radiation to condition point H and mixes through natural convection with rising indoor air at condition point R thereby coming to condition point M2. While descending through natural convection, the air loses its sensible heat by radiation and comes to condition point C and is then heated and humidified by part of the cooling load to come to condition point R. The enthalpy to be carried away by dry air of 1 kg' from the room being cooled is $\Delta i'$ which is less than $\Delta i$ in FIG. 2. It will therefore follow that, if removal of sensible heat also were carried out outside the room, air would have to be circulated through ducts in a greater amount than in the conventional cooling system. However, in the cooling system of this invention a large part of the sensible heat is removed from the cooling load through natural convection and reduction of effect of the mean radiation temperature inside the room, and therefore the blast circulation in the outdoor blast line may be in a small amount just enough for dehumidification only.

In the air cycle of the known system as shown in FIG. 2, all the blast amount necessary for sensible heat removal is circulated through the outdoor blast line and cold water whose temperature is unnecessarily low for sensible heat removal is used for dehumidification, which consumes a large amount of energy and yet the temperature and humidity control are good.

The system embodying the present invention as illustrated in FIG. 3 involves the addition of a dehumidifier which is not used in the prior art system, the rotary type dehumidifier using micronized activated carbon is a compact device capable of providing the necessary dehumidification, and operable by small power. This dehumidifier saves energy, which advantage cannot be expected from other types of dehumidifier, since solar heat or low temperature industrial waste heat may be utilized as the heat source for heating recovered air. By using this dehumidifier the temperature and humidity control is improved as well. Further, as already described, energy saving is also achieved by the greatly reduced outdoor cold losses due to the drastic reduction in the surface area of the outdoor low temperature equipment and in the temperature gap between the equipment and the surrounding air.

Generally, a refrigerator whether of the absorption type or of the compression type runs at the higher coefficient of performance the higher the temperature of the cold water produced by it. That the cold water produced may be at 18° C. greatly contributes toward improved coefficient of performance, in contrast to the prior art cooling system which requires cold water at 7° C. Where the absorption refrigerator produces cold water 7° C. by using hot water at 80° C., its coefficient of performance is about 0.66. If cold water at 18° C. suffices, the coefficient of performance is in the order of 0.86 which is an improvement by about 30 percent.

Further, as already described, during a time period of a small cooling load and an excessive solar heat collection the heat may be accumulated in the high temperature water inside the heat storage tank 3 and additionally cold accumulation is made in cold water at 7° C. within the cold water storage tank 8 which is diluted for use at 18° C. Therefore the cold storage capacity may be regarded as three or four times the actual tank capacity. (During a cold storage operation the coefficient of performance of the refrigerator lowers to the level in the prior art system, but it does not matter during the time period of excessive energy supply).

Representative Climatic Conditions

Outdoor Air Conditions

Temperature: 34° C.

Relative Humidity: 60%

Conditions in a Building

An Office in a Concrete Steel Building

Cooling Area: 80 $m^2$

| Room Air Conditions | Prior Art Cooling System Temperature: 26° C. Relative Humidity: 60% | Cooling system of This Invention Temperature: 28° C. Relative Humidity: 60% |
|---|---|---|
| *Single Effect Absorption Refrigerator | | |
| Sensible Heat Removing Load | 7,000 Kcal/h | 6,000 Kcal/h |
| Dehumidifying Load | 3,000 Kcal/h (5 Kg/h) | — |
| Cooling Water Temperature | 7° C. | 18° C. |
| Coefficient of Performance | 0.66 | 0.86 |
| Necessary Calory Input | 15,200 Kcal/h (22.0 KW) | 7,000 Kcal/h (10.1 KW) |
| *Circulating Fan | | |
| Air amount | 2,400 $m^3$/h | 1,600 $m^3$/h |
| Necessary Power | 1.5 KW | 1.0 KW |
| *Dehumidifier | | |
| Dehumidifying Load | (5 Kg/h) | 3,00 Kcal/h |
| Recovery Air Temperature | | 70° C. |
| Recovery Air amount | | 400 $m^3$/h |
| Recovery Air Blasting Power | | 0.2 KW |
| Rotor Driving Power | 0.1 KW | |
| Hot Water Pump Driving Power | | 0.1 KW |
| Cooling Water Pump Driving Power | | 0.1 KW |
| Necessary Hot Water Calory | 4.4 KW | |
| Comparison Of Power Required | 23.5 KW | 16.0 KW |

The foregoing table compares only these aspects which are different between the two systems.

The energy consumed by a single effect absorption refrigerator using hot water heated by solar heat is said to be 8,096 Kcal per 1 RT (3,024 Kcal/h), including the energy consumed by auxiliary equipement such as pumps, fans and burners. This corresponds to 9.41 KW, and the prior art cooling system in the foregoing example requires 31.1 KW as determined from the following calculation:

$$\frac{10{,}000 \times 9.41}{3{,}024} = 31.1 \text{ (KW)}$$

The system according to this invention consumes energy equal to 7.5 KW less than that consumed by the prior art system, hence $$31.1 - 7.5 = 23.6 \text{ (KW)}$$

Moreover, considering that 10 percent (3 KW) of the 31.1 KW consumed in the prior art system corresponds to the heat losses in the outdoor equipment, the heat losses in the system of the present invention account for 2 percent and thus $$3 - \frac{2}{10} \times 3 = 2.4 \text{ (KW)}$$

wherefore 2.4 KW are saved making for 21.2 KW energy consumption in the system of the present invention.

Accordingly, the cooling system of the present invention achieves an energy consumption saving of about 30 percent over the prior art system, the percentage being derived from the following formula:

$$\frac{31.1 - 21.2}{31.1} \times 100 = 31.8(\%)$$

The cooling system of this invention when used in a hospital, an old-age home or the like provides the following effects.

Among buildings to be cooled, office buildings, dwelling houses, hospitals and hotels have small indoor heat generation compared with the heat entering from outside while the opposite is true in department stores, theaters and factories. While the cooling system according to the present invention is applicable to cooling loads of both types, it is capable of providing far better indoor air conditions than the prior art system particularly for a building in which temperature and humidity must be under strict control, a room where agitation of air is undesirable, a building accommodating aged people, infants or patients with advanced diseases whose health is vulnerable to cold currents, a room where the indoor temperature distribution should desirably be in the cool ceiling and warm floor pattern, and so forth. Thus the cooling system of this invention is particularly suitable to hospitals and old-age homes. This cooling system is also effective to prevent aerial infection within a hospital since extracted air need not be returned and the air supply may wholly comprise outdoor air having been dehumidified during the intermediate seasons. This system is also useful in sterile rooms where the presence of bacteria must be avoided and for the prevention of accidents in factories where poisonous gas is used.

The cooling system of this invention may include two dehumidified air lines for a hospital having wards that need a supply of entirely dehumidified air and wards that allows return air recirculation.

It is the main advantage of the cooling system of this invention over existing cooling systems used in hospitals and old-age homes that this system promotes health, apart from its energy saving features.

I claim:

1. A cooling method comprising:

removing sensible heat from a cooling load including air in a room by cooling means (11) having cooling surfaces in said room to be cooled, by receiving and circulating within said cooling means a circulating cooling medium evaporated in an absorption refrigerator (7) utilizing a heating medium, said circulating cooling medium being received from said absorption refrigerator;

dehumidifying said air by circulating said air through a dry type dehumidifier (13); utilizing said heating medium to regenerate the dehumidifying function of said dry type dehumidifier; and blowing the resulting dehumidified air on said cooling surfaces of said cooling means (11) in a direction substantially parallel to said cooling surfaces, whereby the formation of condensate on said cooling surfaces is avoided.

2. The cooling method of claim 1, wherein said dehumidified air is blown against said cooling surfaces in a direction slightly inclined from said surfaces, and circulated.

3. The cooling method of claim 1, wherein said cooling means (11) are mounted on the ceiling of said room.

4. The cooling method of claim 1, wherein said cooling means (11) are mounted adjacent the ceiling of said room.

5. The cooling method of claim 1, wherein said cooling means (11) comprises a panel type cooler.

6. The cooling method of claim 1, comprising heating said heating medium by solar energy.

7. The method of claim 1, wherein said heating and cooling media comprise water.

8. The method of claim 1, comprising heating said heating medium to up to 100° C. by means of industrial waste heat.

9. The method of claim 1, wherein said cooling medium is evaporated in vacuum.

10. The method of claim 1, wherein cooling fluid is recirculated between said refrigerator (7) and a storage tank (8) and said cooling means (11).

11. The method of claim 1, comprising cooling a load consisting of a mixture of air extracted from said room and outside air.

12. The method of claim 1, carried out when the outside temperature is only slightly higher than the temperature in said room and the absolute humidity does not exceed 15 g/kg comprising dehumidifying outside air only, supplying said air to said room, extracting air from said room and venting same without dehumidification.

13. A cooling system comprising, in combination:

a heat storage tank containing a heating medium; means for heating said heating medium;

an absorption refrigerator receiving said heating medium, and cooling same;

a cooler having a panel having a large area exposed in a room to be cooled;

conduit means for bringing said heating medium as a cooling fluid from said absorption refrigerator to said panel;

a dry-type dehumidifier for dehumifying air in said room by utilizing thermal energy from said heating medium, said dehumidifier comprising a housing, a columnar rotor in said housing, said rotor comprising a honeycomb block formed of corrugated layers of material containing adsorbents, and means for flowing heated air and dehumidified air in opposite directions;

outlet means connected to said dehumidifier for blowing said dehumidified air from said dehumidifier substantially parallel to said panel to avoid condensation thereon; and a heating device connected to said heat storage tank, for heating air to produce said heated air, and conduit means for conducting air thus heated to said adsorbents to regenerate said adsorbents.

14. The system of claim 13, wherein said means for heating said medium consists of a solar energy collector or a source of waste industrial heat.

15. The system of claim 13, wherein said adsorbents consist of activated carbon or fibers thereof.

* * * * *